US008304701B2

(12) United States Patent
Akatsuka et al.

(10) Patent No.: US 8,304,701 B2
(45) Date of Patent: Nov. 6, 2012

(54) CERAMIC HEATER AND METHOD FOR MAKING THE SAME

(75) Inventors: Yuji Akatsuka, Handa (JP); Yoshinobu Goto, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 202 days.

(21) Appl. No.: 12/884,479

(22) Filed: Sep. 17, 2010

(65) Prior Publication Data

US 2011/0062144 A1 Mar. 17, 2011

(30) Foreign Application Priority Data

Sep. 17, 2009 (JP) ..... 2009-216158

(51) Int. Cl.
*H05B 3/06* (2006.01)
*H01B 3/00* (2006.01)

(52) U.S. Cl. ..... 219/532; 219/544; 219/444.1; 219/468.1; 219/552; 219/540; 219/443.1; 219/465.1; 219/466.1; 219/543; 219/546; 219/547; 219/548; 29/611; 29/616; 29/617; 29/610.1; 29/620; 118/427; 118/725

(58) Field of Classification Search ..... 219/532, 219/544, 444.1, 468.1, 552, 540, 443.1, 465.1, 219/466.1, 543–4, 546–8; 29/611, 610.1, 29/616–7, 620; 118/427, 725
See application file for complete search history.

(56) References Cited

U.S. PATENT DOCUMENTS 7,126,090 B2 * 10/2006 Yamaguchi et al. ..... 219/444.1

FOREIGN PATENT DOCUMENTS

JP 2003-288975 A1 10/2003

* cited by examiner

*Primary Examiner* — Shawntina Fuqua
(74) *Attorney, Agent, or Firm* — Burr & Brown

(57) ABSTRACT

A resistive heating element 30 has a higher molybdenum carbide content in a central portion 35 than in a peripheral portion 34. Since molybdenum carbides have a low temperature coefficient of resistance compared to molybdenum, the amount of heat generated in the central portion 35 of the resistive heating element 30 does not increase as much as in the peripheral portion 34 even when the temperature is increased, and the increase in difference in temperature between the peripheral portion 34 and the central portion 35 can be suppressed. In other words, generation of hot spots near the center can be suppressed and a good uniform heating property in a wide range of operation temperatures can be obtained.

10 Claims, 6 Drawing Sheets

CERAMIC HEATER AND METHOD FOR MAKING THE SAME

FIELD OF THE INVENTION

The present invention relates to a method for manufacturing a ceramic heater and to a ceramic heater.

BACKGROUND OF THE INVENTION

Heretofore, ceramic heaters used for heating wafers have been known. Such ceramic heaters are required to have uniform heating properties so that the heaters can heat wafers uniformly. For example, Patent Document 1 discloses a ceramic heater including a resistive heating element composed of molybdenum and buried in a ceramic plate composed of aluminum nitride, and an aluminum nitride shaft joined to the plate, wherein the amounts of metal carbides in the resistive heating element are reduced to reduce the non-uniformity in the amounts of carbides among positions of the resistive heating element and to thereby decrease the temperature distribution in the heating surface.

[Patent Document 1] Japanese Unexamined Patent Application Publication No. 2003-288975.

According to the ceramic heater equipped with a shaft described above, deterioration of the uniform heating property sometimes occurs in a temperature range higher than the designed temperature although the uniformity of the temperature distribution, i.e., the uniform heating property, is good near the designed temperature. For example, when the resistive heating element is heated so that the ceramic heater has a temperature higher than the designed temperature, a hot spot is generated near the center of the heating surface of the ceramic plate, thereby widening the temperature difference between the center and the periphery and deteriorating the uniform heating property. Since the uniform heating property is deteriorated at temperatures other than the designed temperature, ceramic heaters having different designed temperatures are designed every time different process temperatures are used in wafer etching, CVD, etc. However, in recent years, there has arisen a need to change temperature during a process and a heater having a uniform heating property that does not easily degrade despite the temperature changes is desired.

SUMMARY OF THE INVENTION

The present invention has been made to address such a problem and a main object thereof is to provide a ceramic heater that has a good uniform heating property in a wide range of operation temperatures, and a method for making such a ceramic heater.

The present invention has taken following measures to achieve the main object described above.

According to the present invention, a ceramic heater includes:

a disk-shaped ceramic plate mainly composed of aluminum nitride;

a resistive heating element having a unicursal shape, the resistive heating element being buried in the ceramic plate and including molybdenum as a main component and a molybdenum carbide; and a cylindrical shaft having a diameter smaller than an outer diameter of the ceramic plate, the cylindrical shaft being composed of aluminum nitride and joined to a center of the ceramic plate so as to hold the ceramic plate, wherein a molybdenum carbide content in the resistive heating element is higher in a middle portion than in a peripheral portion.

The inventors of the present invention have investigated the cause of deterioration of the uniform heating property at high temperatures higher than the designed temperature and conceived that the cause may be an increased contribution to heat release made by radiation heat transfer among three types of heat conduction at high temperatures. In other words, according to conventional ceramic heaters, since a shaft is bonded to the central portion, the amount of heat escaping from the central portion of the ceramic plate is large at low temperatures due to a large contribution made by solid heat conduction dominant at low temperatures, and thus the temperature of central portion is prevented from increasing. However, at high temperatures, because the contribution by the radiant heat conduction is relatively large and heat easily escapes by radiation from the peripheral portion having no shaft compared to the central portion of the ceramic plate, the amount of heat released by radiation from the peripheral portion becomes relatively high and the temperature of the peripheral portion becomes lower than that of the central portion, thereby deteriorating the uniform heating property at high temperatures. According to the ceramic heater of the invention of the subject application, the molybdenum carbide content in the resistive heating element is higher in the middle portion than in the peripheral portion. Since the temperature coefficient of resistance of molybdenum carbides is lower than that of molybdenum, the resistance value does not increase in the middle portion as much as it does in the peripheral portion even when the temperature is increased. In a unicursal-shape resistive heating element, the magnitude of the current is the same irrespective of the position, and thus the amount of heat generated in the middle portion of the resistive heating element does not increase as much as that in the peripheral portion despite the increase in temperatures. In contrast, the resistance value of the peripheral portion of the resistive heating element increases relatively largely and thus the amount of heat generated in the peripheral portion increases relatively significantly. Accordingly, the relative increase in radiant heat release from the peripheral portion at high temperatures is compensated thereby, and the increase in the difference in temperature between the peripheral portion and the middle portion can be suppressed. As a result, compared to a ceramic heater in which the molybdenum carbide content in the resistive heating element is homogeneous in all parts, the uniform heating property does not easily deteriorate despite the increase in temperature. In other words, a good uniform heating property can be obtained in a wide range of operation temperatures.

According to the ceramic heater of the present invention, the middle portion of the resistive heating element may be a portion included in the circular shaft-opposing region opposing the cylindrical shaft. In this case, the molybdenum carbide content of the resistive heating element may be higher in a region included in a shaft-opposing region than in the peripheral portion. In this manner, the increase in difference in temperature between the peripheral portion and the shaft-opposing region can be suppressed. Accordingly, the deterioration of the uniform heating property caused by the shaft can be further suppressed.

According to the ceramic heater of the present invention, the middle portion of the resistive heating element may be a portion included in the circular region having a diameter larger than an outer diameter of the shaft and smaller than a diameter of the ceramic plate. In other words, the middle portion of the resistive heating element may be a portion included in the circular region the center axis of which coincides with that of the ceramic plate, and a diameter of the circular region may be larger than an outer diameter of the shaft and smaller than a diameter of the ceramic plate. Conventionally, the hot spot caused by the shaft has sometimes reached the region in the outer shaft radial direction of the shaft-opposing region; however, such an increase in difference in temperature between such a region and the peripheral portion can be suppressed by controlling the molybdenum carbide content described here.

According to the ceramic heater of the present invention, a carbon content of the ceramic plate may be higher in a portion in which the middle portion of the resistive heating element is buried than in a portion in which the peripheral portion of the resistive heating element is buried, and the portion in which the middle portion of the resistive heating element in the ceramic plate is buried may be unexposed on a surface of the ceramic plate which is opposite to the surface of the ceramic plate jointed to the cylindrical shaft. In this manner, even if there is a portion in which a carbon content of the ceramic plate is higher than in the other portion, the resistivity does not decrease in the surface of the ceramic plate which is opposite to the surface of the ceramic plate jointed to the cylindrical shaft. As a result, leakage current flowing in a wafer can be prevented when the ceramic plate heats the wafer.

According to the present invention, in the first method for manufacturing a ceramic heater includes:

(a) a step of preparing a die that can form raw material powder into a discoid and placing aluminum nitride raw materials in the die so as to bury a unicursal-shape resistive heating element composed of molybdenum;

(b) a step of performing hot-press firing after step (a) to sinter the aluminum nitride raw materials to thereby prepare the ceramic plate; and (c) a step of joining a cylindrical shaft onto a center of the ceramic plate after step (b), the cylindrical shaft being composed of aluminum nitride and having a diameter smaller than the outer diameter of the ceramic plate, wherein, in step (a), a middle portion of the resistive heating element is buried in an aluminum nitride raw material having a higher carbon content when compared to a peripheral portion of the resistive heating element.

According to the ceramic heater made by this method for making the ceramic heater, the molybdenum carbide content in the resistive heating element is higher in the middle portion than in the peripheral portion. As a result, according to this method for making the ceramic heater, as with the ceramic heater of the present invention described above, a ceramic heater having a good uniform heating property in a wide range of operation temperatures can be obtained.

According to the first method for manufacturing a ceramic heater of the present invention, in step (a), the aluminum nitride raw material having a higher carbon content may be placed in the die so as to be unexposed on a surface of the ceramic plate which is opposite to the surface of the ceramic plate jointed to the cylindrical shaft in step (c). In this manner, even if the aluminum nitride raw material having a high carbon content is placed in the die in step (a), the resistivity does not decrease in the surface of a ceramic plate, obtained by step (b), which is opposite to the surface of the ceramic plate jointed to the cylindrical shaft. As a result, leakage current flowing in a wafer can be prevented when the ceramic plate heats the wafer.

In the second method for manufacturing a ceramic heater according to the present invention includes:

(a) a step of preparing a die that can form raw material powder into a discoid and placing aluminum nitride raw materials in the die so as to bury a unicursal-shape resistive heating element composed of molybdenum;

(b) a step of performing hot-press firing after step (a) to sinter the aluminum nitride raw material to thereby prepare the ceramic plate; and (c) a step of joining a cylindrical shaft onto a center of the ceramic plate after step (b), the cylindrical shaft being composed of aluminum nitride and having a diameter smaller than the outer diameter of the ceramic plate, wherein, in step (a), an aluminum nitride raw material having a particular carbon content is used and a member that can be carbonized by firing in step (b) is placed in the aluminum nitride raw material in which the peripheral portion of the resistive heating element is buried, and the member is not placed in the aluminum nitride raw material in which the middle portion of the resistive heating element is buried.

According to the ceramic heater made by this method for making the ceramic heater, the molybdenum carbide content in the resistive heating element is higher in the middle portion than in the peripheral portion. As a result, according to this method for making the ceramic heater, as with the ceramic heater of the present invention described above, a ceramic heater having a good uniform heating property in a wide range of operation temperatures can be obtained. The "member that can be carbonized by firing in step (b)" may be, for example, a member composed of molybdenum.

According to the first and second method for manufacturing a ceramic heater of the present invention, the middle portion of the resistive heating element may be a portion included in the circular shaft-opposing region opposing the cylindrical shaft joined in step (c); or the middle portion of the resistive heating element may be a portion included in the circular region having a diameter larger than an outer diameter of the shaft joined in step (c) and smaller than an outer diameter of the ceramic plate.

DETAILED DESCRIPTION OF THE INVENTION

Figure 1:
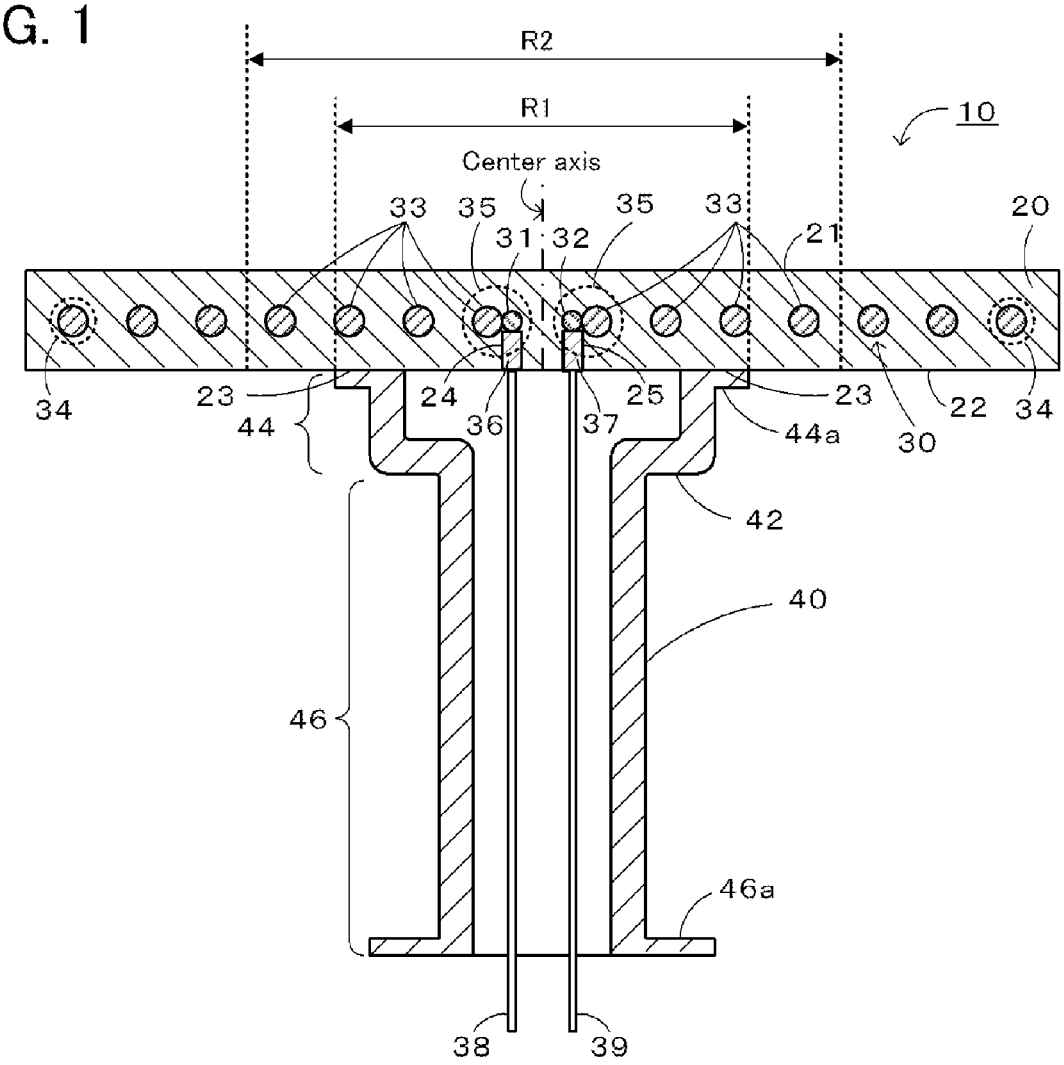
FIG. 1 is a cross-sectional view of a ceramic heater 10.

Embodiments of the present invention will be described below with reference to the drawings. FIG. 1 is a cross-sectional view of a ceramic heater 10 of this embodiment cut at a plane that is parallel to the center axis and passes terminal portions 31 and 32.

The ceramic heater 10 is used to heat a wafer to be subjected to etching, CVD, or the like and is placed in a vacuum chamber not shown in the drawing. The ceramic heater 10 includes a ceramic plate 20 capable of supporting a wafer, a resistive heating element 30 that heats the ceramic plate 20, and a cylindrical shaft 40 that supports the ceramic plate 20.

The ceramic plate 20 is a disk-shaped member mainly composed of aluminum nitride. The resistive heating element 30 that heats a heating surface 21, which is one surface of the ceramic plate 20, is buried in the ceramic plate 20, and the cylindrical shaft 40 is joined to a joint portion 23 at a rear surface 22, which is the other surface of the ceramic plate 20. A first hole 24 and a second hole 25 are formed in the rear surface 22 in the inner radial direction from the joint portion 23. The size of the ceramic plate 20 is not particularly limited but is, for example, 330 to 340 mm in diameter and 18 to 30 mm in thickness. The outer diameter of the joint portion 23 is the diameter R1 (30 to 120 mm).

Figure 2:
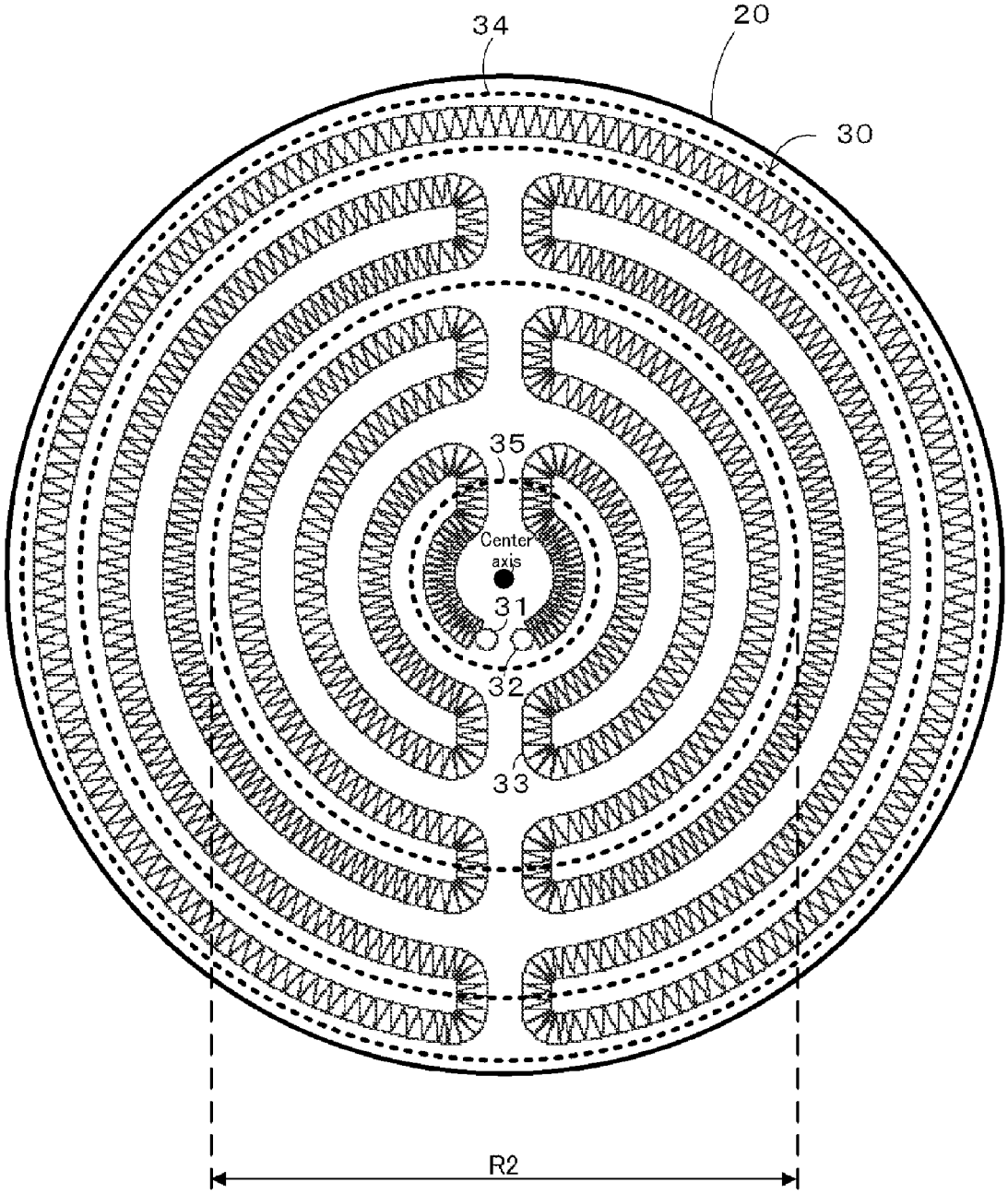
FIG. 2 is an example of a projection pattern of a resistive heating element 30.

The resistive heating element 30 is a coil-shaped member containing molybdenum as a main component and molybdenum carbides. Molybdenum carbides are roughly categorized into $Mo_2C$ and MoC. In the present invention, $Mo_2$ is usually dominant. However, the ratio between these carbides may be any. FIG. 2 shows a projection pattern of the resistive heating element 30 when projected onto the heating surface 21 of the ceramic plate 20. As shown in FIG. 2, the resistive heating element 30 extends from the terminal portion 31, which is one end of the resistive heating element 30 substantially located at the center of the ceramic plate 20, is wired substantially over the entire surface of the ceramic plate 20 as if to draw a unicursal shape, and reaches the terminal portion 32, which is the other end of the resistive heating element 30 substantially located at the center of the plate 20. The terminal portions 31 and 32 are each a member containing molybdenum as a main component and molybdenum carbides, are respectively exposed in the first hole 24 and the second hole 25 in the ceramic plate 20, and are brazed to connecting terminals 36 and 37 composed of Kovar in the first hole 24 and the second hole 25. In this resistive heating element 30, the molybdenum carbide content in a central portion 35 of the resistive heating element 30 closest to the center axis of the ceramic plate 20 is higher than the molybdenum carbide content in a peripheral portion 34 of the resistive heating element 30 closest to the outer periphery of the ceramic plate 20. In particular, the ratio (Ic/Im) of the total value (Ic) of the main peak intensities of the molybdenum carbides to the total value (Im) of the main peak intensities of molybdenum measured by an X-ray diffraction technique is 0.3 or more at the central portion 35 and 0.1 or less at the peripheral portion 34. In this embodiment, the ratio (Ic/Im) of the resistive heating element 30 in a middle portion 33 (including the central portion buried within a circular region having a diameter R2 (60 to 150 mm) in the ceramic plate 20 is 0.3 or more in all parts, as with the central portion 35, and the ratio (Ic/Im) of the resistive heating element 30 in portions other than the middle portion 33 is 0.1 or less in all parts, as with the peripheral portion 34. Note that the diameter R2 is larger than the diameter R1 of the joint portion 23. In other words, in the resistive heating element 30, the middle portion 33, which is a portion included in the shaft-opposing region (circular region with the diameter R1) opposing the cylindrical shaft 40 and a ring-shaped region (region with the inner diameter R1 and the outer diameter R2) of the ceramic plate 20 in the outer radial direction of the shaft-opposing region, has a higher molybdenum carbide content than the peripheral portion 34. The resistive heating element 30 is a coil-shaped member, as described above, and the resistive heat density per unit area of the resistive heating element 30 can be locally varied by adjusting the coil pitch. In this manner, the desired uniform heating property (e.g., temperature distribution within ±4° C.) can be obtained at a designed temperature (450° C. in this embodiment) by considering the difference in resistivity within the resistive heating element 30 caused by the difference in molybdenum carbide content, the difference in the amount of heat released among different positions in the ceramic plate, and the difference in the amount of heat transferred to the cylindrical shaft 40.

The cylindrical shaft 40 is a ceramic member composed of aluminum nitride. The cylindrical shaft 40 has a step 42. With respect to the step 42 serving as a border, the part located on the ceramic plate 20-side is a large diameter portion 44 and a part opposite to the ceramic plate 20 is a small diameter portion 46. A flange 44*a* is formed at an end of the large diameter portion 44 and a flange 46*a* is formed at an end of the small diameter portion 46. The end of the large diameter portion 44 is joined to the joint portion 23 at the rear surface 22 of the ceramic plate 20 so that the center axis of the cylindrical shaft 40 coincides with that of the ceramic plate 20. In the cylindrical shaft 40, power feed rods 38 and 39 composed of nickel and brazed onto the terminal portions 31 and 32 of the resistive heating element 30 via the connecting terminals 36 and 37 are arranged to extend along the axis direction of the cylindrical shaft 40. Electric power is supplied to the resistive heating element 30 through the power feed rods 38 and 39.

Figure 3:
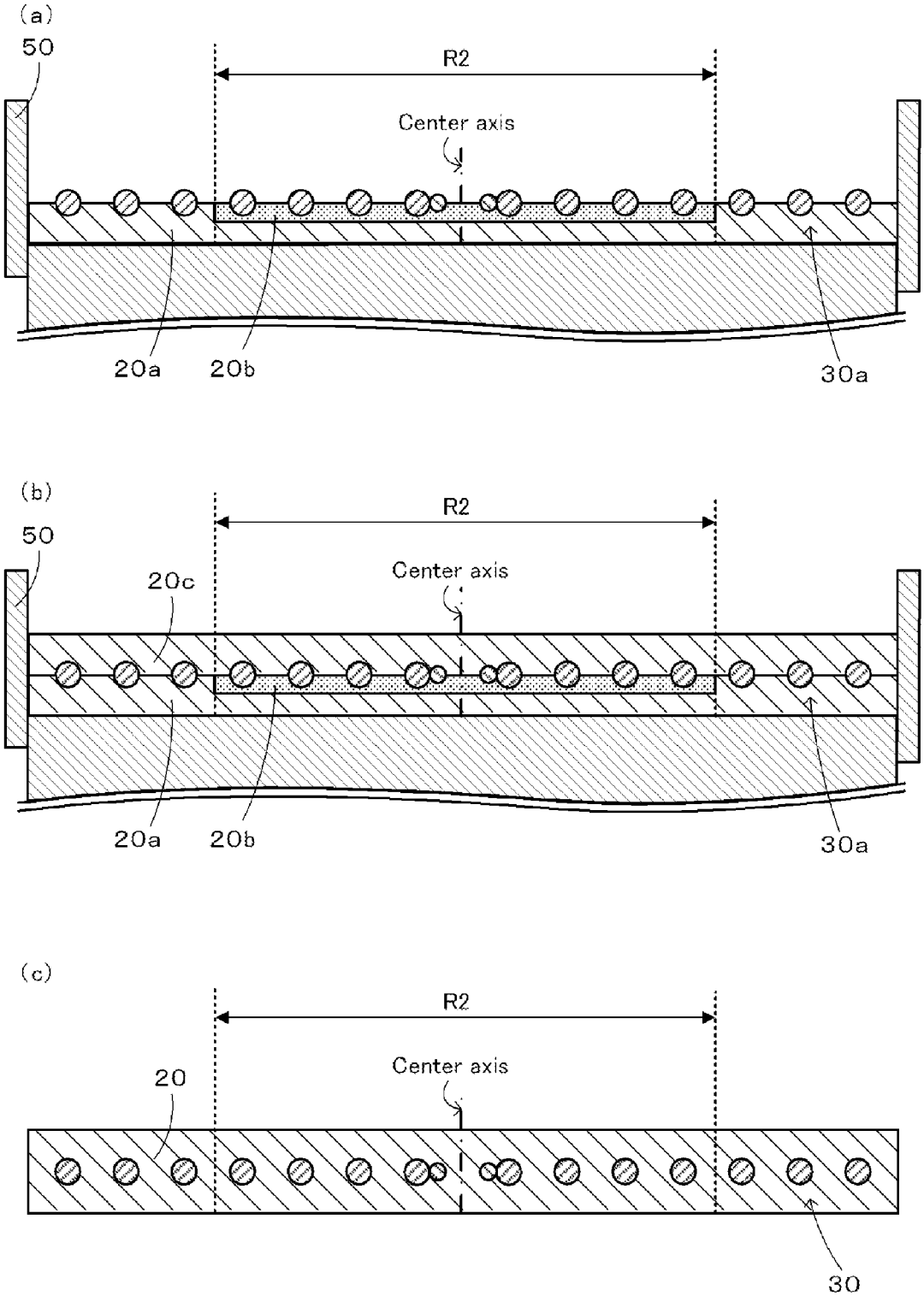
FIG. 3 includes diagrams illustrating a method for making the ceramic heater 10.

Next, a method for making the ceramic heater 10 is described. FIG. 3 includes diagrams illustrating steps of making the ceramic plate 20 of the ceramic heater 10. First, an organic binder (e.g., polyvinyl alcohol) and water are mixed with a powder mainly composed of aluminum nitride to prepare a slurry, and the slurry is spray-dried to prepare a granular powder (referred to as "powder A" hereinafter) and a granular powder (referred to as "powder B" hereinafter) that has a higher organic binder content than regular powders. Since the powder B has a high organic binder content, the carbon content thereof is higher than that of the powder A. Then the powder A is laid into a disk shape in a die 50, pressed to form a recess in a circular region having a diameter R2 from the center of the die 50 to thereby form a lower layer 20*a*, and the powder B is laid in the recess to form a lower layer 20*b*. The lower layers 20*a* and 20*b* are pressed with a groove-forming die to form a semi-circular groove at a position where a resistive heating element 30*a* is to be placed. Then the resistive heating element 30*a* composed of molybdenum is placed (FIG. 3(*a*)). The powder A is further charged in the die 50 to form an upper layer 20*c* and pressing is conducted to obtain a compact in which the resistive heating element 30*a* is buried (FIG. 3(*b*)). The compact is sintered at 1500° C. to 1750° C. by a hot press technique to obtain the ceramic plate 20 shown in FIG. 1 (FIG. 3(*c*)). Here, as shown in FIG. 3(*b*), the lower half of the resistive heating element 30*a* in a region with a diameter R2 or less from the center axis of the die 50 is buried in the powder B having a higher carbon content than the powder A. Thus, the molybdenum carbide content of the resistive heating element 30*a* in the portion (portion corresponding the middle portion 33) within the circular region having a diameter R2 is higher than that of other portions as a result of sintering, and the resistive heating element 30 shown in FIG. 1 is made.

Next, the first hole 24 and the second hole 25 are formed to reach the terminal portions 31 and 32 of the resistive heating element 30 in the obtained ceramic plate 20. Meanwhile, a powder mainly composed of aluminum nitride is formed into a cylindrical shaft by cold isostatic pressing (CIP forming) using a die, fired in nitrogen at a normal pressure, and polished and processed to form the cylindrical shaft 40 shown in FIG. 1. Then the rear surface 22 of the ceramic plate 20 is joined with the cylindrical shaft 40 with an adhesive or by a solid heat diffusing technique such that the center axis thereof coincide with each other, and the power feed rods 38 and 39 and the connecting terminals 36 and 37 are brazed and joined to the holes reaching the terminal portions 31 and 32. As a result, the ceramic heater 10 shown in FIG. 1 can be obtained.

As shown in FIG. 3(*b*), the powder B is placed in the die so as to be unexposed on the heating surface 21 and the rear surface 22 of the ceramic plate. For this reason, even if the powder B having a high carbon content or a low resistivity is used, the resistivity does not decrease in the heating surface 21 of a ceramic plate is obtained. As a result, leakage current flowing in a wafer can be prevented when the ceramic plate 20 heats the wafer.

According to the ceramic heater 10 of this embodiment described in detail above, the molybdenum carbide content of the resistive heating element 30 in the central portion 35 closest to the center axis of the ceramic plate 20 is higher than the molybdenum carbide content of the resistive heating element 30 in the peripheral portion 34 closest to the side surface of the ceramic plate 20. Since the cylindrical shaft 40 is joined to the central part of the ceramic plate 20, the solid heat conduction dominant at low temperatures makes a large contribution near the designed temperature so that the amount of heat escaping from the central part of the ceramic plate 20 is large, thereby not elevating the temperature in the central portion. However, at high temperatures higher than the designed temperature, the contribution by the radiant heat conduction is relatively large, and heat easily escapes by radiation near the periphery having no cylindrical shaft 40 compared to the central part of the ceramic plate 20. Thus, the amount of heat released from the peripheral portion by radiation increases relatively, and hot spots tend to occur near the center. In the ceramic heater 10 of this embodiment, the molybdenum carbide content is higher, in other words, the temperature coefficient of resistance is lower, in the central portion 35 than in the peripheral portion 34. Thus the resistance value of the central portion 35 does not increase as much as that of the peripheral portion 34 despite the increase in temperature. In the unicursal-shaped resistive heating element 30, the magnitude of the current is the same irrespective of the position, and thus the amount of heat generated in the central portion 35 of the resistive heating element 30 does not increase as much as that in the peripheral portion 34 despite the increase in temperature. Thus, the increase in difference in temperature between the peripheral portion 34 and the central portion 35 can be suppressed. In other words, generation of hot spots near the central portion 35 can be suppressed and a good uniform heating property can be obtained in a wide range of operation temperatures.

According to the ceramic heater 10 of this embodiment, the molybdenum carbide content in the of the middle portion 33 included in a circular region which includes the shaft-opposing region and a region of the ceramic plate 20 in the outer shaft radial direction of the shaft-opposing region and which has a diameter R2 smaller than the outer diameter of the ceramic plate 20 is higher than the molybdenum carbide content in the peripheral portion 34. In other words, a molybdenum carbide content is higher in the middle portion 33 which is a portion included in the circular region having a diameter R2 larger than an outer diameter R1 of the cylindrical shaft 40 and smaller than a diameter of the ceramic plate 20 than in the peripheral portion 34. Thus, although the hot spots caused by the cylindrical shaft 40 reach the shaft-opposing region and the region in the outer shaft radial direction from the shaft-opposing region, the increase in difference in temperature between such a region and the peripheral portion 34 can also be suppressed.

Moreover, a carbon content of the ceramic plate 20 is higher in a portion in which the middle portion 33 of the resistive heating element 30 is buried than in a portion in which the peripheral portion 34 of the resistive heating element 30 is buried, and the portion in which the middle portion 33 of the resistive heating element 30 in the ceramic plate is buried is unexposed on the heating surface 21 of the ceramic plate which is opposite to the rear surface 22 of the ceramic plate jointed to the cylindrical shaft 40. For this reason, even if there is a portion in which a carbon content of the ceramic plate 20 is higher than in the other portion, the resistivity does not decrease in the heating surface 21 of the ceramic plate 20 which is opposite to the rear surface 22 of the ceramic plate 20 jointed to the cylindrical shaft 40. As a result, leakage current flowing in a wafer can be prevented when the ceramic plate 20 heats the wafer.

Note that the present invention is not limited by the embodiments described above and can naturally be implemented through various embodiments as long as they are within the technical scope of the present invention.

For example, in the embodiments described above, the ratio (Ic/Im) is 0.3 or more in the middle portion 33 and is 0.1 or less in parts other than the middle portion 33; however, it is sufficient if the molybdenum carbide content is higher in the central portion 35 than in the peripheral portion 34. For example, the ratio (Ic/Im) may be controlled to gradually decrease from the central portion 35 toward the peripheral portion 34.

In the embodiments described above, the diameter R2 is larger than the diameter R1; however, the diameter R2 may be the same as the diameter R1 or the diameter R2 may be smaller than the diameter R1.

In the embodiments described above, the peripheral portion 34 is a portion closest to the outer periphery of the ceramic plate 20; however, the peripheral portion may be a portion except the middle portion 33 of the resistive heating element 30.

In the embodiments described above, the firing temperature for obtaining the ceramic plate 20 is 1500° C. to 1750° C.; however, the temperature may be 1500° C. to 1650° C. Firing at low temperatures can suppress carbonization of the resistive heating element 30*a* in a portion buried only in the powder A having a low carbon content, and only the portion of the resistive heating element 30*a* inside the region having a diameter of R2 or less (the portion corresponding to the middle portion 33) can be assuredly carbonized.

In the embodiments described above, the ceramic plate 20 is obtained by firing while the lower half of the part of the resistive heating element 30*a* inside the circular region having a diameter R2 is being buried in the powder B having a higher carbon content than the powder A; however, firing may be conducted while the part of the resistive heating element 30*a* inside the circular region having the diameter R2 is being entirely buried in the powder B.

In the embodiments described above, the powder B is placed in the die 50 so as to be unexposed on the heating surface 21 and the rear surface 22 of the ceramic plate 20; however, the powder B may be placed in the die so as to be exposed on the rear surface 22. If the powder B is placed in the die 50 so as to be unexposed on the heating surface 21 of the ceramic plate 20, leakage current flowing in a wafer can be prevented when the ceramic plate 20 heats the wafer.

In the embodiments described above, the resistive heating element 30 is a coil-shaped member; however, it may be a meshed member.

In the embodiments described above, The resistive heating element 30 is buried in the ceramic plate 20; however, an electrode for electrostatically chucking a wafer may be further buried therein.

In the embodiments described above, in making the ceramic plate 20 in which the resistive heating element 30 including the middle portion 33 and the peripheral portion 34 having different molybdenum carbide contents is buried, the powder A and the powder B having different carbon contents are used for the manufacture as shown in FIG. 3; however, other methods may be employed for manufacture. An example of the manufacturing method will now be described with reference to FIG. 4. First, a powder mainly composed of aluminum nitride is mixed with an organic binder and water to prepare a slurry and the slurry is spray-dried to prepare a granular powder (referred to as "powder C" hereinafter). The powder C should contain a particular amount of carbon and the carbon content thereof may be different from those of the powders A and B. Subsequently, the powder C is laid into a disk shape in a cylindrical die 150 to prepare a lower layer 120*a*, and a molybdenum mesh 60*a* (a mesh sheet formed by interweaving molybdenum wires having a diameter of 0.12 mm) which has a ring shape with an inner diameter not less than diameter R2 (e.g., 120 mm) and an outer diameter not more than the diameter of the inner peripheral surface of the die 150 and not less than the outer diameter of the resistive heating element 30 is placed on the lower layer 120*a* so that its center axis coincides with the center axis of the die 150. Then the powder C is placed thereon to prepare a lower layer 120*b*, and a resistive heating element 130*a* composed of molybdenum is placed thereon (FIG. 4(*a*)). Then the powder C is placed thereon to form an upper layer 120*c*. After the resistive heating element 130*a* has been sufficiently buried in the upper layer 120*c*, a molybdenum mesh 60*b* identical to the molybdenum mesh 60*a* is placed thereon so that its center axis coincides with the center axis of the die 150. The powder C is further charged to form an upper layer 120*d* and pressing is conducted to obtain a compact in which a resistive heating element 130*a* is buried (FIG. 4(*h*)). As a result, the molybdenum mesh 60*a* and 60*b* is placed in the aluminum nitride raw material in which the peripheral portion 134*a* of the resistive heating element 130*a* is buried, and the molybdenum mesh 60*a* and 60*b* is not placed in the aluminum nitride raw material in which the middle portion 133*a* of the resistive heating element 130*a* is buried. Then the compact is sintered by a hot press technique to obtain a ceramic plate 120 (FIG. 4(*c*)). According to this process, not only the resistive heating element 130*a* but also the molybdenum meshes 60*a* and 60*b* are carbonized by firing. Thus, carbonization of the resistive heating element 130*a* in a portion near where the molybdenum meshes 60*a* and 60*b* are buried, namely, the portion within a ring-shaped region having a diameter from the center axis larger than the diameter R2, is suppressed compared to a portion in a circular region having a diameter R2 from the center axis of the die 150. As a result, the resistive heating element 130 after firing has a molybdenum carbide content higher in a middle portion 133 included in the circular region having a diameter R2 as with the resistive heating element 30 than in other portions. The ceramic plate 120 that can offer the same advantages as the ceramic plate 20 described above can be obtained by this process also. The molybdenum meshes 60*a* and 60*b* do not have to be meshes and may be plate-shaped members. The material is not limited to molybdenum and any member that can be carbonized by firing can be used. Moreover, only one of the molybdenum meshes 60*a* and 60*b* may be buried. It is sufficient if molybdenum meshes are present in larger amounts in a portion closest to the inner peripheral surface of the die 150 than in a portion closest to the center axis of the die 150. For example, molybdenum meshes may be buried in a region having a diameter not more than R2.

EXAMPLES

Example 1

In Example 1, a specific example corresponding to the ceramic heater 10 of the embodiment shown in FIGS. 1 and 2 was made by a method illustrated in FIG. 3. In particular, the example was prepared as follows.

First, the ceramic plate 20 was prepared. To 30 parts by weight of aluminum nitride powder (99.5° purity) containing 5 wt % yttria, 0.5 parts by weight polyvinyl alcohol serving as an organic binder and 100 parts by weight water were mixed to prepare a slurry. The slurry was spray-dried to prepare a powder A. A powder B was prepared in the same manner but with a slurry containing the organic binder in an amount 30 times larger. The prepared powders A and B were chemically analyzed to investigate the carbon content. The carbon content was 0.1 wt % in the powder A and 3 wt % in the powder B. Next, the powder A was laid in a die having an inner diameter of 350 mm and a recess was formed by pressing the powder with a die having a diameter of 350 mm and a middle portion (diameter: 110 mm) protruding by 1 mm. Then the powder B was laid in the recess formed at the center and pressed with a groove-forming die to form a semicircular groove at a position where the resistive heating element 30*a* was to be placed. Next, the resistive heating element 30*a* composed of molybdenum was placed in the groove. The powder A was charged thereon in the die and pressed with a flat die at 10 MPa to prepare an aluminum nitride compact in which the resistive heating element 30*a* was buried. The resistive heating element 30*a* was a coil-shaped member with a molybdenum single wire diameter of 0.5 mm and a winding diameter of 3 mm. Small balls each having a diameter of 3 mm composed of molybdenum and having a hole the molybdenum single wire could pass through were installed to both ends of the single wire by caulking to form the terminal portions 31 and 32. The resistive heating element 30*a* had a designed temperature of 450° C. and was designed so that the temperature distribution of the heater surface was within ±4° C. at 450° C. The compact was placed in a graphite die, charged into a graphite hot press furnace, and uniaxially pressed at a pressure of 10 MPa while being heated in a nitrogen atmosphere at 1.02 atm and heating rate of 500° C./h. After the maximum temperature of 1650° C. was kept for 1 hour, the compact was cooled in the furnace to be fired. The fired compact was polished and processed into a particular shape to obtain the ceramic plate 20 shown in FIG. 1. The obtained ceramic plate 20 had an outer diameter of 340 mm and a thickness of 18 mm. The distance from the side surface of the ceramic plate 20 to the peripheral portion 34 of the resistive heating element 30*a* was 7 mm in the ceramic plate radial direction. The distance from the center axis of the ceramic plate 20 to the central portion 35 of the resistive heating element 30*a* was 6 mm in the ceramic plate radial direction. The first hole 24 and the second hole 25 were formed in the ceramic plate 20 so that the holes reached the buried terminal portions 31 and 32. The terminal portions 31 and 32 which were small balls were partially removed to form flat surfaces and were exposed at the bottoms of the first hole 24 and the second hole 25.

Meanwhile, a mixed powder containing aluminum nitride powder and 0.5 wt % yttria powder was formed into a cylindrical shaft by cold isostatic pressing (CIP forming) using a die, fired in nitrogen at a normal pressure, and polished and processed to obtain the cylindrical shaft 40 shown in FIG. 1. Next, the cylindrical shaft 40 was joined to the center of the ceramic plate at the side where the first hole 24 and the second hole 25 were formed. In joining, the flatness of the surface to be joined was adjusted to 10 μm or less. Next, an adhesive was evenly applied onto the joint surface of the shaft so that the amount of the adhesive was 14 g/cm$^2$. The joint surfaces of the ceramic plate 20 and the cylindrical shaft 40 were bonded to each other and retained at a bonding temperature of 1450° C. in nitrogen gas for 2 hours. The heating rate was 3.3° C./min and the nitrogen gas ($N_2$, 1.5 atm) was introduced from 1200° C. Pressure was applied to press aluminum nitride sintered products against each other in a direction perpendicular to the joint surfaces. Application of a pressure of 4 MPa started from 1200° C., continued while maintaining the bonding temperature of 1450° C., and ended when cooled to 700° C. A paste prepared by mixing calcium carbonate and alumina powder with a small amount of water to achieve a compositional ratio of 54 wt % CaO-46 wt % $Al_2O_3$ was used as a bonding material. Note that the diameter of the joint portion 23 is 72 mm. After the ceramic plate 20 was bonded to the cylindrical shaft 40, the power feed rods 38 and 39 composed of nickel were brazed onto the connecting terminals 36 and 37 in the first hole 24 and the second hole 25 of the ceramic plate 20. This brazing was conducted with a gold filler and a Kovar alloy interposed between the rods and the terminals. As a result, the ceramic heater 10 of the present invention was made.

Example 2

In Example 2, the ceramic heater 10 was prepared as in Example 1 except that a powder D was used instead of the powder B of Example 1. The powder D was prepared by mixing 30 parts by weight aluminum nitride powder (99.5 purity) containing 5 wt % yttria with 1 part by weight carbon black, 0.5 parts by weight polyvinyl alcohol serving as an organic binder, and 100 parts by weight water to make a slurry, and spray-drying the slurry to prepare a granular powder (referred to as powder D hereinafter). The carbon content in the powder D was 3.4 wt %.

Example 3

Figure 4:
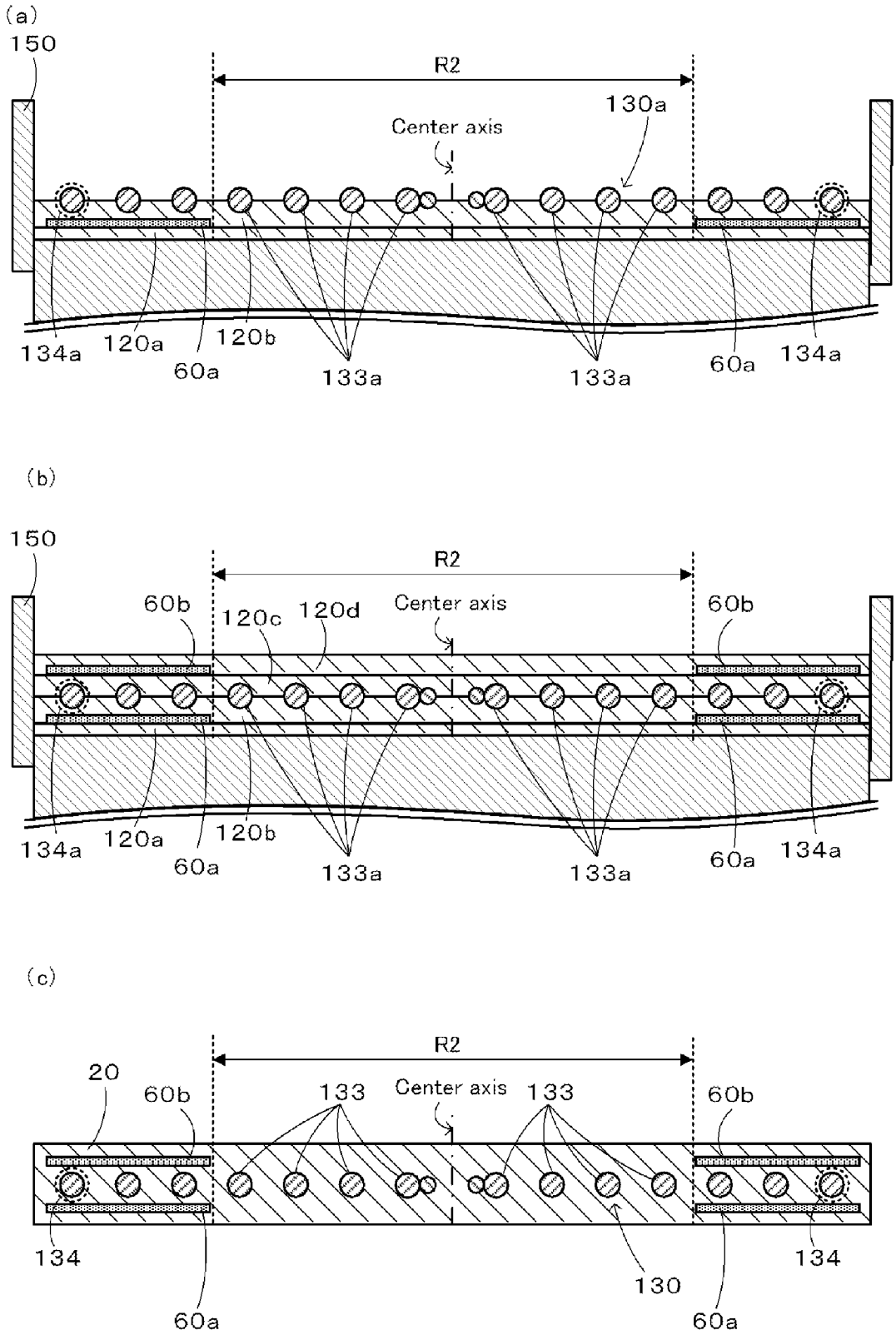
FIG. 4 includes diagrams illustrating another method for making the ceramic heater 10.

In Example 3, a specific example corresponding to a ceramic heater 110 of an embodiment made by the method illustrated in FIG. 4 was prepared. In particular, the example was made as follows.

First, to 30 parts by weight of aluminum nitride powder (99.5% purity) containing 5 wt % yttria, 4 parts by weight polyvinyl alcohol serving as an organic binder and 100 parts by weight water were mixed to prepare a slurry. The slurry was spray-dried to prepare a granular powder as powder C. The carbon content in the powder C was 0.8 wt %. The powder C was laid in a die to form a disk having a thickness of 15 mm and a flat surface. Then a ring-shaped molybdenum mesh 60*a* (a metal mesh sheet prepared by interweaving molybdenum wires having a diameter of 0.12 mm) having an outer diameter of 325 mm and an inner diameter of 120 mm was placed in a die in a concentric manner. The powder C was further laid thereon to a thickness of about 1 mm and pressed with a groove-forming die identical to that of Example 1 to form a compact having a groove. The resistive heating element 130*a* having the same shape as one shown in FIG. 2 was placed in the groove. The powder C was charged thereon to a thickness of about 6 mm so that the resistive heating element 130*a* is sufficiently hidden and pressed with a flat die to flatten the surface of the compact. Then another ring-shaped mesh 60*b* was placed on the flat surface of the compact. The powder C was further charged thereon and pressed with a die to form a compact including the resistive heating element 130*a* and the molybdenum meshes 60*a* and 60*b* buried therein. The compact was sintered by a hot-press technique as in Example 1. However, the sintering temperature was 1800° C. Other sintering conditions were the same as those of Example 1. The cylindrical shaft was joined as in Example 1 and the power feed rods were brazed to form the ceramic heater 110.

Example 4

In Example 4, the ceramic heater 10 was prepared as in Example 1 except that instead of forming a recess by pressing the powder A laid in a die having an inner diameter of 350 mm with a die having a diameter of 350 mm and a middle portion (110 mm in diameter) protruding by 1 mm, a recess was formed by pressing the powder with a die having a diameter of 350 mm and a middle portion (280 mm in diameter) protruding by 1 mm.

Comparative Example

In Comparative Example, a ceramic heater 210 was prepared as in Example 1 except the powder B was not used and the powder A was used instead. The firing temperature of the ceramic plate was 1700° C.

[Evaluation Test 1]

The test pieces obtained in Examples 1 to 4 and Comparative Example were placed in a vacuum chamber and heated to 450° C. (designed temperature), 550° C., 650° C., and 700° C. The temperature distribution at the ceramic heater surface at each temperature was measured from outside the chamber with an infrared radiometer (IR camera). The difference ΔT between the maximum value and the minimum value of the temperature was calculated from the resulting temperature distribution. The results are shown in Table 1. The heater was heated to each temperature by controlling the temperature through a thermocouple not shown in the drawing attached to the rear surface of the ceramic plate.

TABLE 1

| Temperature of the heater | | 450° C. | 550° C. | 650° C. | 700° C. |
|---|---|---|---|---|---|
| ΔT (° C.) | Example 1 | 3.4 | 4.2 | 6.4 | 9.3 |
| | Example 2 | 3.7 | 4.8 | 7.3 | 10.5 |
| | Example 3 | 3.7 | 5.0 | 8.2 | 12.3 |
| | Example 4 | 1.9 | 3.2 | 4.8 | 6.2 |
| | Comparative Example | 3.6 | 8.4 | 14.5 | 22.7 |

As apparent from Table 1, ΔT at the designed temperature was satisfactory, namely, within ±4° C., in all Examples 1 to 4 and Comparative Example. However, in Comparative Example, ΔT significantly increased with the temperature of the heater. In contrast, Examples 1 to 4 all exhibited small ΔT compared to Comparative Example, which shows they have better uniform heating property in a wide temperature range than Comparative Example.

[Evaluation Test 2]

Next, obtained ceramic plates of test pieces of Examples 1 to 4 and Comparative Example were cut in 2 cm grids perpendicular to the heating surfaces of the ceramic plates to obtain rectangular prism specimens in which resistive heating elements were exposed in sections. The section of the resistive heating element of each specimen was subjected to X-ray diffraction analysis. The intensity Im of the main peak Mo(110) of molybdenum and the intensity Ic of the main peak $Mo_2C$(100) of molybdenum carbide were measured, and the ratio Ic/Im was calculated. In X-ray diffraction analysis of Examples 1 to 3 and Comparative Example, the main peak of MoC among molybdenum carbides was not observed. Thus, in evaluation test 2, the intensity of the $Mo_2C(100)$ was directly used as Ic. The results are shown in Table 2. The position where the specimen was taken in Table 2 is indicated in terms of a diameter with the center axis of the ceramic heater at the center. The X-ray analysis conditions were CuKα, 50 kV, 300 mA, 2θ=20 to 70° and the instrument used was RINT produced by Rigaku Corporation.

TABLE 2

| | | Position where the specimen was taken (mm) | | | | |
|---|---|---|---|---|---|---|
| | | 12 | 90 | 194 | 270 | 300 |
| Ic/Im | Example 1 | 0.42 | 0.40 | 0.05 | — | 0.07 |
| | Example 2 | 0.38 | 0.35 | 0.06 | — | 0.07 |
| | Example 3 | 0.32 | 0.28 | 0.07 | — | 0.09 |
| | Example 4 | 0.42 | 0.40 | 0.38 | 0.38 | 0.08 |
| | Comparative Example | 0.06 | 0.08 | 0.08 | — | 0.12 |

As apparent from Table 2, in Examples 1, 2, and 4, since the resistive heating element is relatively carbonized in the middle portion of the resistive heating element, i.e., the region with a diameter of R2 or less (R2 is 110 mm in Examples 1 and 2 and 280 mm in Example 4), the ratio Ic/Im is 0.3 or more in the middle portion. The ratio Ic/Im is 0.1 or less in other regions in which the resistive heating element remains relatively uncarbonized. In Example 3, since the middle portion of the resistive heating element is relatively carbonized, the ratio Ic/Im in the region having a diameter of R2 (=110 mm) or less is 0.2 or more, and, in particular, the ratio is 0.3 or more in the middle portion (portion where the position from which the specimen was taken was 12 mm) while the ratio Ic/Im is 0.1 or less in other regions in which the resistive heating element remains relatively uncarbonized. In other words, in Examples, the Ic/Im and the molybdenum carbide content in the middle portion (region with a diameter of R2 or less) of the resistive heating element are three times or more larger than those in other portions. In contrast, in Comparative Example, the ratio Ic/Im of the resistive heating element is about 0.1 or less regardless of the position. It is presumed that in Examples 1 to 3, since the molybdenum carbide content in the middle portion of the resistive heating element is high, good uniform heating property is obtained in a wide temperature range as indicated in Table 1. Note that in Comparative Example, the ratio Ic/Im of the specimen taken at a position having a diameter of 300 mm is 0.1 or more; however, this may be attributable to the difference in firing temperature between Comparative Example and Examples 1, 2, and 4. In other words, in Examples 1, 2, and 4 and Comparative Example, the resistive heating element is buried in the powder A at a position having a diameter of 300 mm; however, in Examples 1, 2, and 4, the sintering temperature of the ceramic plate is 50° C. lower than that of Comparative Example. Accordingly, it is contemplated that in Examples 1, 2, and 4, the carbonization of the resistive heating element in the portion buried in only the powder A having a low carbon content is suppressed compared to Comparative Example, and thus the ratio Ic/Im is assuredly adjusted to 0.1 or less.

Figure 5:
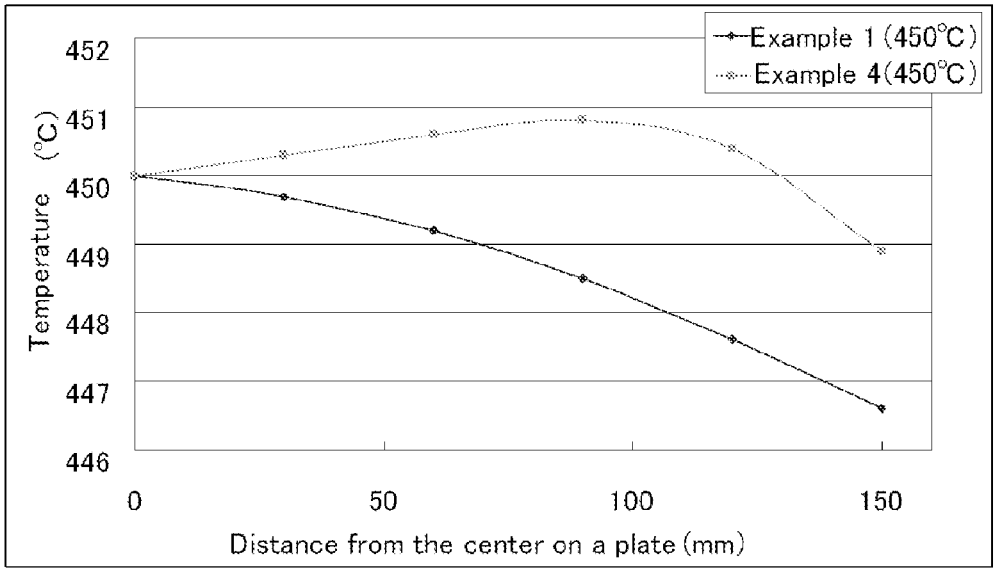
FIG. 5 is a graph showing temperature distributions of Examples 1 and 4 at 450° C.
Figure 6:
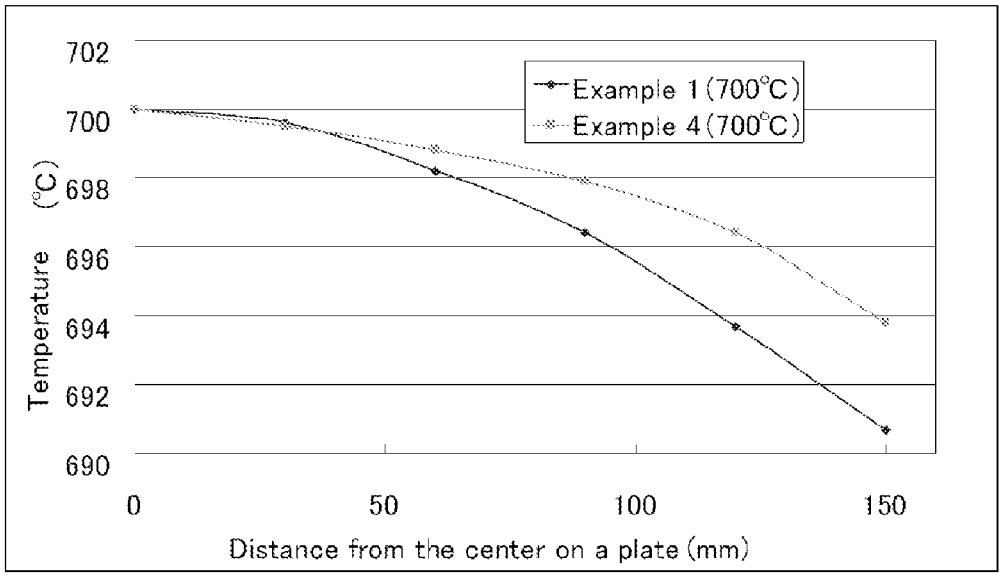
FIG. 6 is a graph showing temperature distributions of Examples 1 and 4 at 700° C.

The temperature distributions of the ceramic heater surfaces of Examples 1 and 4 heated to 450° C. in evaluation test 1 are shown in FIG. 5 and the temperature distributions of the ceramic heater surfaces of Examples 1 and 4 heated to 700° C. in evaluation test 1 are shown in FIG. 6. In FIGS. 5 and 6, the horizontal axis indicates the distance from the center of the heater plate and the vertical axis indicates the average of the temperature on concentric circles each with a radius equal to the distance from the center. FIGS. 5 and 6 show that the temperature distribution of the ceramic heater surface differs between Examples 1 and 4 having different ranges in which the resistive heating element is carbonized. In general, the temperature distribution in which the temperature gently decreases from the center toward the outer periphery as that of Example 1 is preferred; however, depending on the process, the temperature distribution in which the temperature decreases only in the center part and the outer periphery as that of Example 4 in FIG. 5 is preferred. Accordingly, a ceramic plate having an optimum temperature distribution can be fabricated by combining the distribution of the resistive heat density and the range of carbonization in accordance with the requirement of the process. Moreover, as apparent from the results of evaluation test 1 shown in Table 1, in all cases, a heater having a desired temperature and a small variation in temperature distribution from low temperature to high temperature can be obtained according to the present invention.

[Evaluation Test 3]

Figure 7:
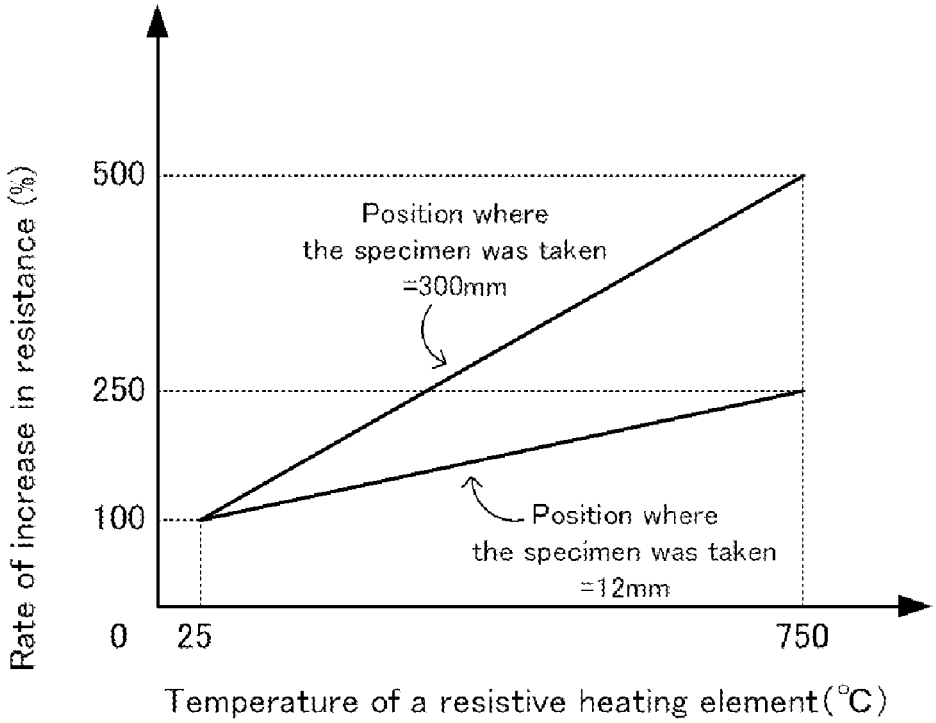
FIG. 7 is a graph showing the relationship between the temperature of a resistive heating element and the rate of increase in resistance.

Next, specimens of Example 1 respectively taken at a position of 12 mm and a position of 300 mm were used. Leads were connected to two ends of a section of each resistive heating element by using a silver paste, and each specimen was placed in a nitrogen atmosphere furnace and heated from room temperature (25° C.) to 750° C. to measure the variation in resistance value versus temperature. The results are shown in FIG. 7. Note that the variation in resistance value is indicated in terms of the rate of increase in resistance value on the basis of the resistance value at 25° C.

As apparent from FIG. 7, the rate of increase in resistance value against the increase in temperature of the portion taken at 12 mm, i.e., the portion with a high molybdenum carbide content, is about half that of the portion taken at 300 mm, i.e., the portion with a low molybdenum carbide content. The resistive heating element of this embodiment is formed as if to draw a unicursal shape and the power is supplied from the power feed rods 38 and 39 only. Thus, the current that flows in the resistive heating element is the same irrespective of the position. Accordingly, in a location where the rate of increase in resistance value is halved, the increase in heat value caused by the increase in temperature is also halved. Accordingly, the amount of heat generated does not increase in the middle portion of the resistive heating element as much as in the peripheral portion despite the increase in temperature, the increase in difference in temperature between the peripheral portion and middle portion can be suppressed, and the deterioration of the uniform heating property can be prevented.

The present application claims priorities from Japanese Patent Application No. 2009-216158 filed on Sep. 17, 2009, the entire contents of shish is incorporated herein by reference.

What is claimed is:

1. A ceramic heater comprising:

a disk-shaped ceramic plate mainly composed of aluminum nitride;

a resistive heating element having a unicursal shape, the resistive heating element being buried in the ceramic plate and including molybdenum as a main component and a molybdenum carbide; and a cylindrical shaft having a diameter smaller than an outer diameter of the ceramic plate, the cylindrical shaft being composed of aluminum nitride and joined to a center of the ceramic plate so as to hold the ceramic plate;

wherein a molybdenum carbide content in the resistive heating element is higher in a middle portion than in a peripheral portion; and wherein a carbon content of the ceramic plate is higher in a portion in which the middle portion of the resistive heating element is buried than in a portion in which the peripheral portion of the resistive heating element is buried, and the portion in which the middle portion of the resistive heating element is buried is unexposed on a surface of the ceramic plate which is opposite to the surface of the ceramic plate jointed to the cylindrical shaft.

2. The ceramic heater according to claim 1, wherein the middle portion of the resistive heating element is a portion included in the circular shaft-opposing region opposing the cylindrical shaft.

3. The ceramic heater according to claim 1, wherein, the middle portion of the resistive heating element is a portion included in the circular region having a diameter larger than an outer diameter of the shaft and smaller than a diameter of the ceramic plate.

4. A method for making the ceramic heater comprising:

(a) a step of preparing a die that can form raw material powder into a discoid and placing aluminum nitride raw materials in the die so as to bury a unicursal-shape resistive heating element composed of molybdenum;

(b) a step of performing hot-press firing after step (a) to sinter the aluminum nitride raw materials to thereby prepare the ceramic plate; and (c) a step of joining a cylindrical shaft onto a center of the ceramic plate after step (b), the cylindrical shaft being composed of aluminum nitride and having a diameter smaller than the outer diameter of the ceramic plate, wherein, in step (a), a middle portion of the resistive heating element is buried in an aluminum nitride raw material having a higher carbon content when compared to a peripheral portion of the resistive heating element.

5. A method for making the ceramic heater according to claim 4, wherein, in step (a), the aluminum nitride raw material having a higher carbon content is placed in the die so as to be unexposed on a surface of the ceramic plate which is opposite to the surface of the ceramic plate jointed to the cylindrical shaft in step (c).

6. A method for making the ceramic heater according to claim 4, wherein, the middle portion of the resistive heating element is a portion included in the circular shaft-opposing region opposing the cylindrical shaft joined in step (c).

7. A method for making the ceramic heater according to claim 4, wherein, the middle portion of the resistive heating element is a portion included in the circular region having a diameter larger than an outer diameter of the shaft joined in step (c) and smaller than a diameter of the ceramic plate.

8. A method for making the ceramic heater comprising:

(a) a step of preparing a die that can form raw material powder into a discoid and placing aluminum nitride raw materials in the die so as to bury a unicursal-shape resistive heating element composed of molybdenum;

(b) a step of performing hot-press firing after step (a) to sinter the aluminum nitride raw material to thereby prepare the ceramic plate; and (c) a step of joining a cylindrical shaft onto a center of the ceramic plate after step (b), the cylindrical shaft being composed of aluminum nitride and having a diameter smaller than the outer diameter of the ceramic plate, wherein, in step (a), an aluminum nitride raw material having a particular carbon content is used and a member that can be carbonized by firing in step (b) is placed in the aluminum nitride raw material in which the peripheral portion of the resistive heating element is buried, and the member is not placed in the aluminum nitride raw material in which the middle portion of the resistive heating element is buried.

9. A method for making the ceramic heater according to claim 8, wherein, the middle portion of the resistive heating element is a portion included in the circular shaft-opposing region opposing the cylindrical shaft joined in step (c).

10. A method for making the ceramic heater according to claim 8, wherein, the middle portion of the resistive heating element is a portion included in the circular region having a diameter larger than an outer diameter of the shaft joined in step (c) and smaller than a diameter of the ceramic plate.

* * * * *